US005114173A

United States Patent [19]

Goud et al.

[11] Patent Number: 5,114,173

[45] Date of Patent: May 19, 1992

[54] SAFETY SKI BINDING

[75] Inventors: Gilles R. Goud, Cran Gevrier; Jean-Claude Brischoux, Annecy le Vieux, both of France

[73] Assignee: Salomon S.A., Annecy Cedex, France

[21] Appl. No.: 448,911

[22] Filed: Dec. 12, 1989

[30] Foreign Application Priority Data

Dec. 13, 1988 [FR] France ..... 88 16399

[51] Int. Cl.[5] ..... A63C 9/18

[52] U.S. Cl. ..... 280/633; 280/634

[58] Field of Search ..... 280/620, 623, 625, 631, 280/632, 633, 634, 605

[56] References Cited

U.S. PATENT DOCUMENTS 4,620,719 11/1946 Stritzl ..... 280/633

4,676,520 6/1987 Gasquet et al. ..... 280/605

FOREIGN PATENT DOCUMENTS 8808415 9/1988 Fed. Rep. of Germany .

2497459 7/1982 France .

2614545 11/1988 France .

*Primary Examiner*—Andres Kashnikow

*Assistant Examiner*—Richard Camby

*Attorney, Agent, or Firm*—Sandler, Greenblum & Bernstein

[57] ABSTRACT

A safety binding apparatus for alpine skiing. The binding includes a longitudinal slide affixed to the upper surface of the ski, a body solidly affixed to a base longitudinally slidably mounted on the slide and including a retention jaw, preferably for the rear end of the boot, as well as an energization mechanism for the jaw, an elastic return device which includes a recoil spring for biasing the body towards the front, and a linkage device positioned between the body and the ski, permitting an adjustment of the longitudinal position of the body of the binding. The elastic return device is mounted in a housing formed in the upper surface of the ski and the recoil spring is inserted between a support element solidly affixed to the ski and the linkage device.

43 Claims, 6 Drawing Sheets

SAFETY SKI BINDING

BACKGROUND OF THE INVENTION

1. Field of the Invention

The present invention relates to a ski binding, particularly to a rear safety binding, for an alpine ski.

2. Discussion of Background Information

In the practice of alpine skiing, the skier's boot is maintained immobilized between a binding or front abutment, holding the front end of the boot, and a rear binding or heel binding, holding the rear end of the boot, these two bindings being able to release and free the boot in case of a fall. Each of these bindings includes a body solidly affixed to a base and supporting a retention jaw for holding the end of the boot as well as an energization mechanism for the jaw.

To ensure the elastic engagement of the boot and to permit the rear binding to follow the flexion movements of the ski, the body of the rear binding is generally slidably mounted, by means of its base, on a slide affixed to the ski, and it can move slightly towards the rear on the slide, against an elastic return device. The elastic return device comprises one or more recoil springs which are lodged in the body of the binding. The recoil spring (or springs) rests, at one of its ends, on the body and, at its other end, on a length adjustment latch which is likewise lodged in the body. This length adjustment latch, which is continuously biased by the recoil spring (or springs), is shaped so as to engage, by means of a latching tooth, in one of several notches which are provided in the slide, while being aligned longitudinally. The adjustment of the longitudinal position of the binding on the ski occurs by engaging the latch in a predetermined notch of the slide rack.

Because of this type of construction, the body of the rear binding is relatively bulky because it is necessary to provide, in its lower part, a relatively significant housing for the recoil springs and the length adjustment latch.

SUMMARY OF THE INVENTION

The present invention attempts to overcome disadvantages of known bindings by obtaining a rear binding with a simplified design and whose body has a particularly reduced height.

To this end, it is an object of the present invention to provide a ski binding apparatus which includes:

(a) means for engaging an end of a ski boot for positioning the ski boot upon a ski;

(b) a base upon which the engaging means is mounted; and (c) means for connecting the base to the ski at a predetermined rest position including (i) means for elastically biasing the base in a predetermined longitudinal direction on the ski and (ii) means for selectively longitudinally adjusting the predetermined rest position of the base upon the ski.

The binding apparatus of the invention is particularly adapted to engage the rear of a ski boot.

According to one aspect of the invention, the means for elastically biasing the base includes means for containing at least one spring and a force transmission element, the containing means being rigidly affixed to the ski, the force transmission element being selectively removably connected to the base, and the force transmission element being longitudinally biased within the containing means by the spring.

According to one embodiment of the invention, the base includes a plurality of longitudinally spaced apertures, and the force transmission element includes a tooth which is adapted to be selectively placed within one of the apertures.

In a particular aspect of the invention, the containing means includes a cartridge having a fixed length adapted to be received in an opening in an upper portion of the ski, and the means for selectively longitudinally adjusting the predetermined rest position of the base upon the ski includes a number of removable wedge members for selective positioning within the opening in the ski.

According to another embodiment of the invention, a slide is provided upon which the base is longitudinally slidably received, the containing means including a cartridge having a fixed length adapted to be received in an opening in the slide, and the means for selectively longitudinally adjusting the predetermined rest position of the base upon the ski includes a number of removable wedge members for selective positioning within the opening in the slide.

Further according to the invention, the cartridge is adapted to be received in an opening in an upper portion of the ski which opening coincides with the opening in the slide.

According to a further embodiment of the invention, the force transmission element includes a plurality of longitudinally spaced apertures, and the base carries a member which is adapted to be selectively placed within one of the apertures.

According to a still further embodiment of the invention, the means for selectively longitudinally adjusting the predetermined rest position of the base includes a threaded member mounted for rotation and engaged within a threaded aperture of the force transmission element.

It is an additional object of the present invention to provide a rear binding for an alpine ski, adapted to hold the rear end of a boot on the ski, including:

a binding body;

a jaw carried by the body for retention of the rear end of the boot;

an energization mechanism for the jaw, also carried by the body;

a base upon which the body is solidly affixed;

a slide upon which the base is longitudinally slidably mounted;

a housing including an opening formed in the upper surface of the ski; and means for elastically biasing the body forwardly, including (i) a recoil spring and (ii) means for linking the body and the ski for permitting an adjustment of the longitudinal position of the body, the elastically biasing means being mounted in the housing formed in the upper surface of the ski, the recoil spring being positioned between a fixed support element solidly affixed to the ski and the linking means.

In one aspect of the invention, the housing is constituted by a longitudinally elongated opening which is hollowed in the upper surface of a longitudinal projection of the ski, and by a longitudinally elongated slot which is provided in the slide which is affixed to the projection of the ski and which extends above the opening provided in the ski.

In another aspect of the invention, the linking means includes a force transmission element, longitudinally movable in the housing of the ski, biased forwardly by the recoil spring, and a coupling element positioned between the base of the binding and the force transmission element.

According to a further aspect of the invention, the coupling element between the base of the binding and the force transmission element is constituted by a tooth solidly affixed to the force transmission element, extending upwardly and engaging in a notch provided in the base.

In one embodiment of the invention, the coupling element is removable and is constituted by a screw screwed in a tapped hole provided in the base, extending through the tapped hole, the screw having an end which constitutes a projection engaging in one of several holes provided in the force transmission element and being longitudinally spaced from one another.

It is a further object of the invention to provide a binding apparatus in combination with a ski brake, in which the binding apparatus includes a base, the screw, which ensures the coupling between the base of the binding and the force transmission element, ensures the blocking of the base of the ski brake on the base of the binding, while being engaged within a hole provided in the base of the ski brake located above the tapped hole provided in the base of the binding.

In a still further aspect of the invention, the removable coupling element is constituted by a plug extending vertically through a hole provided in the base of the binding and engaged in a hole of the force transmission element.

According to another embodiment of the invention, the force transmission element includes an upper horizontal plate in which several holes are provided which are longitudinally spaced from one another, and in which the removable plug is engageable.

According to a still further embodiment of the invention, the force transmission element includes an upwardly extending projection in the form of a sleeve constituting a blind hole in which the removable plug is engageable.

In a still further embodiment of the invention, the removable plug has, at an upper end, a lateral projection.

Specifically according to another embodiment of the invention, the force transmission element includes an upper horizontal plate supporting the coupling element between the base of the binding and the force transmission element and at least one frontal wall extending downwardly and constituting a support surface for the front end of the recoil spring.

Still further, the upper horizontal plate of the force transmission element includes, at its rear end, a squared edge extending downwardly and constituting a rear frontal wall on which the front end of the recoil spring rests.

Additionally, the upper horizontal plate of the force transmission element includes, at its front end, a squared edge extending downwardly and constituting a front transverse wall.

In a further specific embodiment of the invention, the force transmission element includes a section member having a transverse section in the shape of an inverted U, open at its rear end and closed at its front end by a front transverse wall against which the front end of the recoil spring rests.

In another embodiment of the invention, the elastically biasing means is mounted directly in the housing.

Specifically, the recoil spring rests, at a rear end thereof, directly on a rear transverse wall of the housing and, at a front end thereof, on a transverse wall of the force transmission element which includes an upper horizontal plate.

Still further, the upper horizontal plate of the force transmission element includes a front end which is pressed against an internal surface, forming a ramp inclined from bottom to top and from rear to front of a wedge positioned in the extreme front part of the housing against the front transverse wall of the housing, the ramp of the wedge joining, at its upper end, a projection of the wedge which extends rearwardly and which forms a retention abutment in the upper position for the front end of the upper horizontal plate of force transmission element.

In a specific embodiment of the invention, the elastically biasing means of the body includes an independent recoil cartridge which is tightly nested in the housing provided in the ski and the slide.

According to a still further aspect of the invention, the recoil cartridge has a generally parallelepiped shape and has dimensions which correspond closely to those of the housing provided in the ski and the slide.

Still further, the recoil cartridge has a length less than that of the housing and at least one removable wedge is provided to fill the space remaining between the recoil cartridge and one of the frontal walls of the housing.

Further according to this aspect of the invention, the recoil cartridge is held in the housing by a plurality of removable wedges of different thicknesses inserted between the frontal walls of the recoil cartridge and the frontal walls of the housing.

According to an additional embodiment of the invention, the ski and the slide have a plurality of housings positioned side-by-side and longitudinally offset longitudinally with respect to one another, the recoil cartridge being capable of being placed in any one of the housings.

According to a still further embodiment of the invention, the recoil cartridge contains two opposed compression springs, the force transmission element being positioned between them, one of the two springs being positioned between a first transverse wall of the housing of the cartridge and a first end of an upper horizontal plate of the force transmission element, the other of the two springs being positioned between a second transverse wall of the housing and a free piston longitudinally slidably mounted within the housing, the piston having a frontal surface which is inclined so as to constitute a ramp on which the second end of the upper horizontal plate of the force transmission element rests, so as to continuously bias the force transmission element upwardly so that the coupling element that it supports projects to the exterior of the housing while being, in a state of equilibrium, held elastically in a position in which it is at different respective distances from the two longitudinal ends of the recoil cartridge.

In an additional embodiment of the invention, the linking means includes a force transmission element, longitudinally movable in the housing of the ski, biased forwardly by the recoil spring, and a coupling element positioned between the base of the binding and the force transmission element, the recoil cartridge includes two parts, an upper housing and a lower cover, which is affixed to the housing by means of screws, the force transmission element being positioned in a space defined between the upper housing and the lower cover, the force transmission element including an upper horizontal plate which supports, on its upper surface, the coupling element projecting upwardly, the coupling element extending through a longitudinally elongated slit which is provided in the upper end of the housing, the upper plate of the force transmission element being extended, at a rear end, by a squared edge extending downwardly and which constitutes a rear transverse wall on which the front end of the recoil spring rests, whose rear end rests on a rear transverse wall of housing, and a front end of the upper horizontal plate of the force transmission element rests against a ramp which is inclined from bottom to top and from rear to front, the inclined ramp constituting the internal surface of the front wall of the housing.

In a still further embodiment of the invention, the base of the binding has an upper horizontal member which includes a succession of notches generally aligned longitudinally, forming a rack, in which a coupling element of a force transmission element can be engaged, the notches defining the various longitudinal positions that the body of the binding can take on the slide.

More specifically, the coupling element includes a tooth which has a recess in its upper surface, the recess being adapted to receive the end of a tool to push the tooth downwardly, outside of the notch.

In another embodiment of the invention, the recoil cartridge contains a screw for adjustment of the longitudinal position of the heel binding, the screw extending longitudinally within the recoil cartridge and including a front threaded part by which it is screwed in the force transmission element, the screw supporting, behind a front part thereof, a collar serving to support the front end of the recoil spring whose rear end rests against an intermediate transverse and vertical wall of the housing of the recoil cartridge, the screw extending through the intermediate wall and the head of the screw being located in a space defined between the intermediate wall and the rear transverse wall of the housing, and the upper end of the housing being provided with an opening above the space so as to permit the introduction into the space of a tool for turning the screw.

Further, the coupling element of the force transmission element is engaged in a hole provided in a retractable tongue joined to the body of the binding.

According to a further, specific aspect of the invention, a rear part of the coupling tooth of the force transmission element includes a bevel, inclined from bottom to top and from rear to front, so that under the effect of a forward thrust exerted on the body and the base, the tooth and the force transmission element are pushed downwardly due to the action exerted by the rear edge of each notch on the bevel.

In another embodiment of the invention, the coupling element of the force transmission element is engaged in a notch formed in the lower surface of a slider which is longitudinally adjustably mounted in a downwardly open housing which is provided in the base of the binding.

Additionally, the longitudinal position of the slider is adjustable by means of a screw extending longitudinally and whose head is rotationally mounted, while being held in axial translation, on a transverse wall provided in the rear part of the base, the threaded rod of screw being screwed in a longitudinal tapped hole of the slider.

BRIEF DESCRIPTION OF THE DRAWINGS

Preferred embodiments of the invention will now be described by way of non-limiting examples, with reference to the annexed drawings, in which.

DETAILED DESCRIPTION OF THE PREFERRED EMBODIMENTS

The rear binding of the present invention is adapted to maintain the rear end of a boot on the ski, for use in alpine skiing, the binding including a longitudinal slide affixed to the upper surface of the ski, a body solidly affixed to a base mounted sliding longitudinally on the slide and comprising a retention jaw for the rear end of the boot, as well as an energization mechanism for the jaw, an elastic return device, including a recoil spring biasing the body towards the front, and a linkage means positioned between the body and the ski permitting an adjustment of the longitudinal position of the body. Particularly, the elastic return device is mounted in a housing formed in the upper surface of the ski and the recoil spring is inserted between a support element solidly affixed to the ski and the linkage means.

Figure 1:
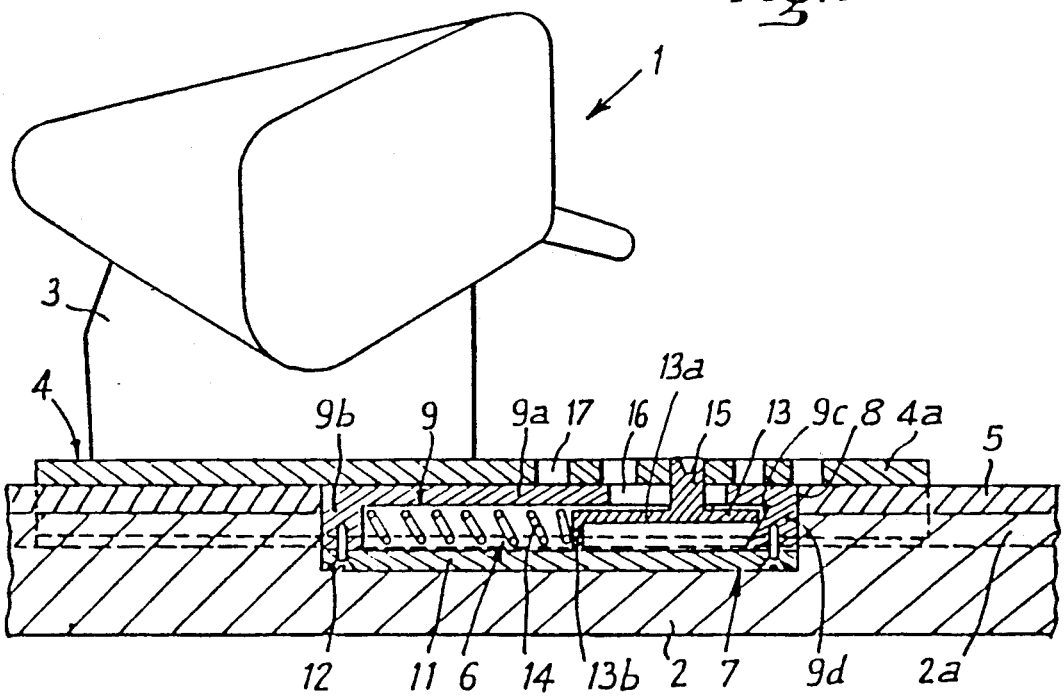
FIG. 1 is a vertical and longitudinal sectional view of a rear binding for an alpine ski according to the invention, latched in longitudinal position.
Figure 2:
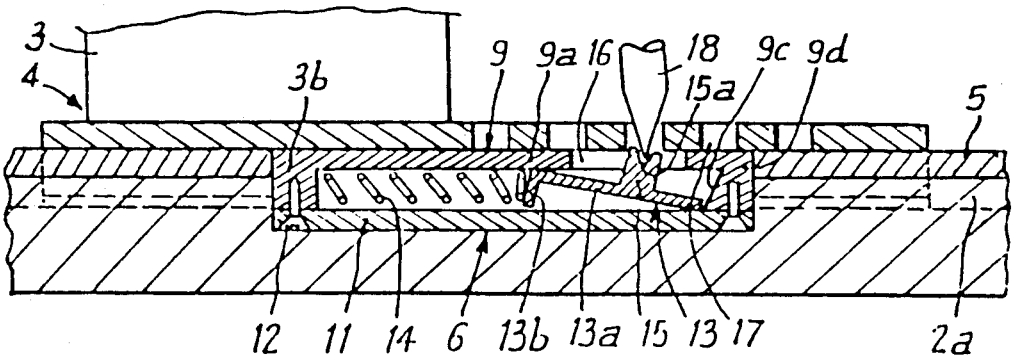
FIG. 2 is a vertical and longitudinal sectional view of the rear binding of FIG. 1, in the unlatched position.
Figure 3:
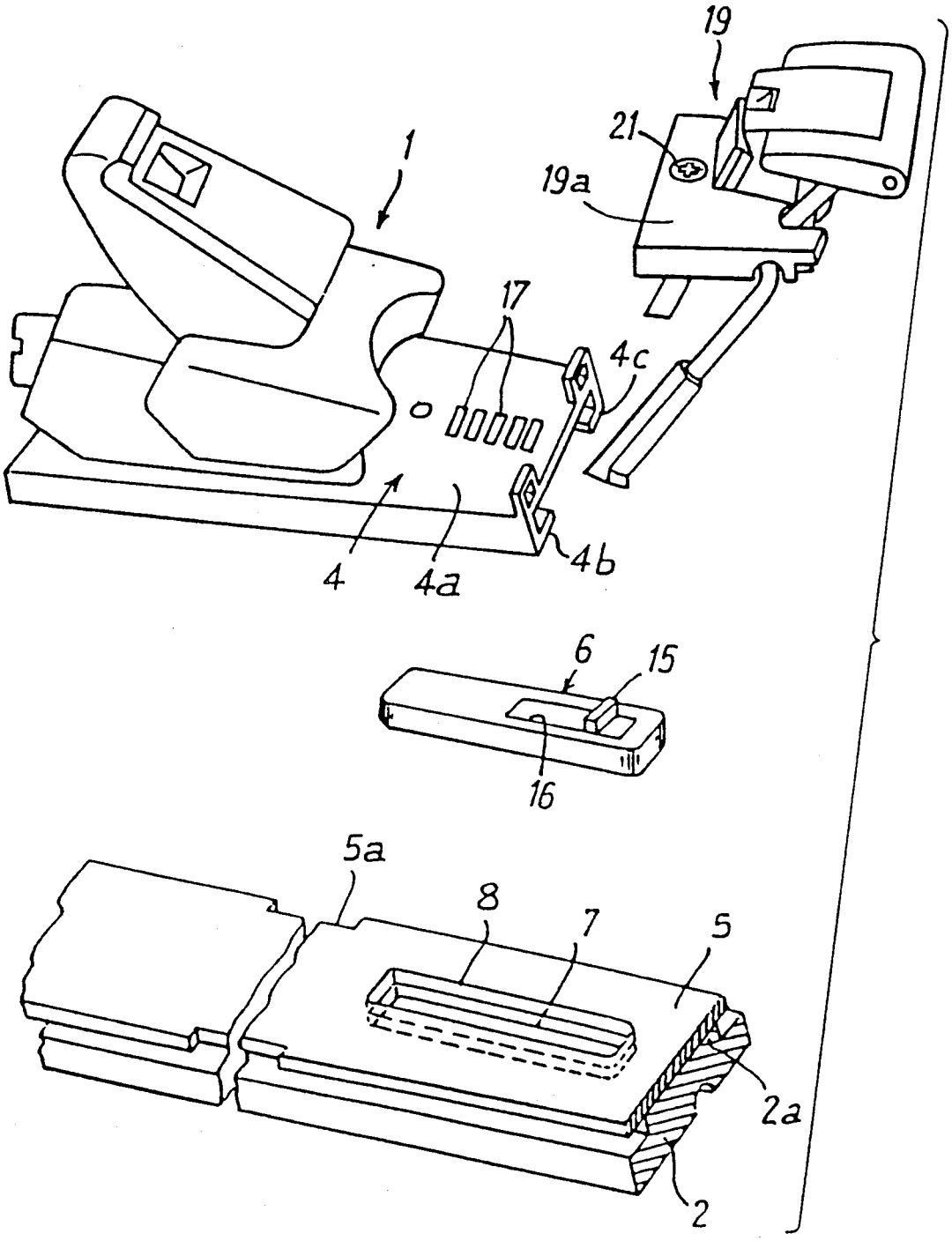
FIG. 3 is an exploded perspective view of the rear binding of FIG. 1 to which a ski brake is joined.

The rear binding or heel binding which is shown in FIGS. 1-3 and which is designated in its entirety by reference numeral 1, is mounted in an adjustable longitudinal position on a ski 2. This heel binding comprises a body 3 which supports, in its front part, a retention jaw for the rear end of the boot and which is solidly affixed, at its lower part, to a base 4. This base 4 is mounted for longitudinal sliding on a slide 5 which is affixed to the upper horizontal surface of the ski 2 by any appropriate means, for example, by means of screws. The slide 5 is constituted by a metallic plate which can be originally assembled with base 4 of body 3 of the binding or, according to an alternative embodiment, as is shown in FIGS. 1-3, slide 5 constitutes a platform which is affixed to an upper longitudinal projection 2*a* of ski 2, this projection having a rectangular transverse section whose width is less than that of ski 2. The platform constituting the slide 5 has a width greater than that of projection 2*a* but, however, less than that of ski 2 so that its two longitudinal edges extend slightly beyond the two longitudinal edges of projection 2*a*, without reaching sides 2*b*, 2*c* of ski 2. The base 4 of body 3 has, in transverse cross-section, the shape of a downwardly open C and it includes an upper horizontal member 4*a* extended downwardly, along its two longitudinal edges, through two lateral parts 4*b*, 4*c* folded in the shape of hooks opening inwardly, one towards the other. The width of the lower opening of base 4 having a C-shaped transverse section is selected as slightly greater than the width of a narrower part 5*a* of slide 5, as shown in FIG. 3, which permits the engagement of the heel binding 1 on the slide 5 first by a movement perpendicular, or substantially perpendicular, to the plane of the slide 5, then by a longitudinal movement on the slide. In any case, base 4 and slide 5 are shaped so as to be engaged in one another with a minimum of lateral play, while permitting a longitudinal sliding of base 4 and, consequently, of body 3 with respect to the slide 5 affixed to the ski.

To permit the gripping of a boot between a front binding, not shown, and heel binding 1, and to permit the heel binding 1 to follow the flexion movements of the ski, heel binding 1 is mounted on slide 5 so as to be able to slide towards the rear against an elastic return device 6. According to the invention, this elastic return device 6 is placed in a housing which is formed both in ski 2, more particularly in its longitudinal projection 2*a*, and in slide 5. This housing is constituted by an opening 7 elongated longitudinally, which is hollowed in the upper surface of the longitudinal projection 2*a* of ski 2, and by a slot 8, elongated longitudinally, which is provided in the slide 5 and which extends above opening 7, over the same length as the latter. The elastic return device 6 of body 3 is constituted, in this non-limiting embodiment, by an independent recoil cartridge which is tightly nested in the housing constituted by superimposed opening 7 and slot 8. The recoil cartridge 6 has a generally parallelepiped shape whose dimensions correspond closely to those of the volume defined by superimposed opening 7 and slot 8. This longitudinally elongated parallelepiped shape is not limiting and any other appropriate shape could be suitable for the recoil device.

The recoil cartridge 6 is provided in two parts, namely an upper housing 9 and a lower cover 11 which is affixed to housing 9 by means of screws 12. In the space defined between upper housing 9 and the lower cover 11 are lodged the actual elastic return means which comprise an element 13 constituting a means for linking or transmitting the force between body 3 or, more particularly its base 4, and ski 2 and, additionally, a length adjustment latch and a recoil spring 14 elastically biasing latch 13 forwardly. This latch 13 is constituted by an upper horizontal plate 13*a* which supports on its upper surface a coupling element constituted by a tooth 15 projecting upwardly therefrom. This tooth 15 extends through a slit 16, elongated longitudinally, which is provided in the upper end 9*a* of housing 9. A relatively significant play is provided between the ends of slit 16 and tooth 15, to permit a longitudinal clearance of limited amplitude for latch 13, this clearance being necessary for the recoil movement of the binding 1.

The upper horizontal plate 13*a* of latch 13 extends, at its rear end, by a squared edge 13*b* extending downwardly, and which constitutes a rear frontal wall on which rests the front end of recoil spring 14. This spring is a compression spring whose rear end rests on the rear transverse wall 9*b* of housing 9. The front end of the upper horizontal plate 13*a* rests against a ramp 9*c* which is inclined from bottom to top and from rear to front. This inclined ramp 9*c* constitutes the internal surface of the front wall 9*d* of housing 9.

Moreover, base 4 has, in the front part of its upper horizontal member 4*a*, a succession of notches 17 generally longitudinally aligned, forming a rack. These notches 17 are constituted by holes provided on both sides of member 4*a* of base 4, and they define the various longitudinal positions that heel binding 1 can occupy on slide 5. Notches 7 can have any appropriate shape and are particularly shown as rectangularly shaped, elongated transversely in plan view, as shown in FIG. 3.

In the latching position, as is shown in FIG. 1, latch 13 is in the upper horizontal position, within housing 9, under the action of recoil spring 14. In effect, this spring pushes plate 13*a* forwardly which, by sliding on the inclined ramp 9*c* by its front end, makes the latch assembly 13 ascend into its upper horizontal position. In this position, tooth 15 extends through slit 16 of the end of housing 9 and is engaged in one of the notches 17 corresponding to the desired longitudinal position. The height of tooth 15 is selected to be substantially equal to the sum of thicknesses of the end 9*a* of housing 9 and of member 4*a* of base 4. In this latching position, heel binding can be pushed elastically towards the rear, to ensure the gripping of the boot and to permit elastic displacement of the boot during the practice of skiing. When the heel binding 1 is biased rearwardly, its base 4 moves the tooth 15 and latch assembly 13 in this direction against the action of recoil spring 14.

If it is desired to modify the adjustment of the longitudinal position of heel binding 1 on slide 5, the latch 13 is merely retracted within housing 9, as is illustrated in FIG. 2. This can be achieved by means of a tool 18, such as a screwdriver, which is engaged vertically through notch 17 in which tooth 15 is located, so as to push the tooth 15 downwardly, within housing 9, so it can escape from notch 17. To facilitate this retracting movement, tooth 15 preferably has a recess 15*a* in its upper surface, which is adapted to receive the end of tool 18. Once the tooth 15 is retracted downwardly in housing 9, under member 4*a* of base 4, it is then possible to make body 3 of the heel binding slide longitudinally in one direction or the other on slide 5.

The recoil cartridge 6, which includes housing 9 closed by cover 11, recoil spring 14, and latch 13, can be delivered with ski 2 or with heel binding 1. Different types of recoil cartridges can be used, having, for example, different colors, which are differentiated by the stiffness of spring 14 and/or by the amplitude of the course of recoil and/or the position of the tooth 15 on latch 13, which then results in a different length adjustment for body 3 of the binding. For the mounting of heel binding 1 on ski 2, the operator first places the recoil cartridge 6 in housing 7, 8, previously formed in ski 2 and slide 5, then he or she engages body 3 of the heel binding on slide 5. The operator then moves body 3 of the heel binding as far as the final longitudinal position desired which depends on the position of the front abutment and the length of the boot. It is to be noted that during this displacement, tooth 15 must be able to traverse, in most cases, one or more notches 17 before reaching the final notch. To avoid having to drive tooth 15 downwardly, for example by means of a screwdriver 18 as is illustrated in FIG. 2, during the passage of each notch 17, one can equip base 4 of the heel binding with ejectable plugs closing notches 17. It is then merely necessary, before mounting, to "pop-out" the plug corresponding to the correct, or desired, longitudinal position of the heel binding 1. This feature is disclosed in copending application Ser. No. 07/394,721, the subject matter of which is hereby incorporated by reference.

Figure 4:
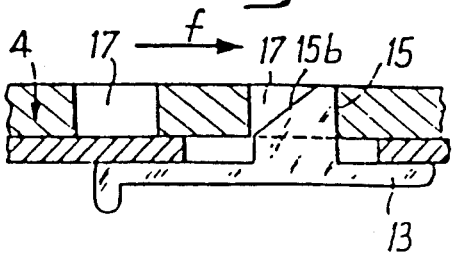
FIG. 4 is a partial vertical and longitudinal sectional view of an alternative embodiment of the element for transmission of the force of the elastic return device.

There can also be formed, on the rear part of tooth 15 of latch 13, a bevel 15*b*, as is shown in FIG. 4. The bevel 15*b* is inclined from bottom to top and from rear to front, so that under the effect of a frontward thrust, illustrated by arrow f in FIG. 4, exerted on body 3 and base 4, tooth 15 and latch 13 are pushed downwardly due to the action exerted by the rear edge of each notch 17 on bevel 15*b*. For this to take place, the bevel 15*b* must extend in the latching position, i.e., when tooth 15 is engaged to the maximum extent in a notch 17, slightly beneath the rear edge of notch 17, so that this edge can slide on bevel 15*b*. On the other hand, in usage, when base 4 biases tooth 15 and latch 13 rearwardly, tooth 15 remains blocked in notch 17 in which it is located. With such a positioning with tooth 15 provided with bevel 15*b*, it is necessary to engage body 3 of heel binding 1 from rear to front on slide 5.

Heel binding 1 which is shown in FIG. 3, is joined to a detachable ski brake 19, which can be assembled with heel binding 1 by means of screws 21. The notches 17 which are provided in the upper horizontal member 4*a* of the base 4 situated under base 19*a* of ski brake 19 when the latter is affixed to heel binding 1. Consequently, to be able to have access to tooth 15 of latch 13, it is necessary to detach ski brake 19 beforehand. However, if one uses plugs for hiding notches 17, or even a tooth 15 having a bevel 15*b*, it is not necessary to have direct access to latch 13 and, consequently, body 3 of the heel binding can be mounted on slide 5 with ski brake 19 assembled with heel binding 1. On the other hand, to modify the longitudinal position of heel binding 1, it may be necessary to detach ski brake 19, so as to have access to tooth 15 of latch 13, with a view to retracting the latter within housing 9 of recoil cartridge 6.

Figure 5:
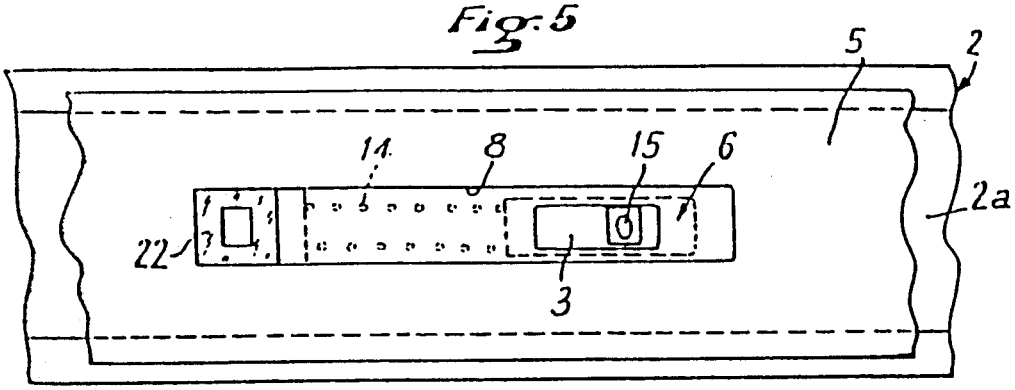
FIG. 5 is a plan view of the part of the slide and the ski where the recoil cartridge is lodged, with usage of a removable wedge.
Figure 6:
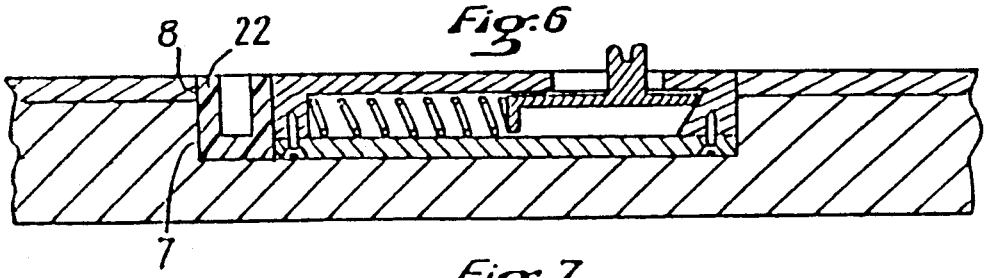
FIG. 6 is a view in vertical and longitudinal sectional view along line VI—VI of FIG. 5.
Figure 7:
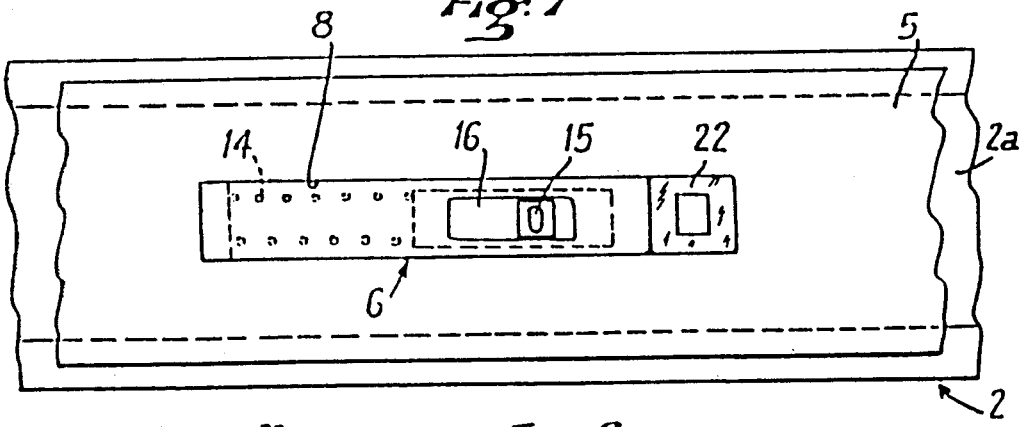
FIG. 7 is a plan view of the recoil cartridge of FIG. 5 mounted in a different longitudinal position.

In the alternative embodiments shown in FIGS. 5–7, housing 7, 8 for recoil cartridge 6 is longer than the cartridge. A removable wedge 22 is used to fill in the space existing between the recoil cartridge 6 and one of the frontal walls of housing 7, 8. The removable wedge 22 can be placed at the rear end of housing 7, 8 as shown in FIGS. 5 and 6, or even at the front end of the housing as shown in FIG. 7. These two positions correspond to the different longitudinal positions of tooth 15 of latch 13 and, consequently, to two different length adjustment areas, for example, an area corresponding to an adult's boot and an area corresponding to a child's boot.

Figure 8:
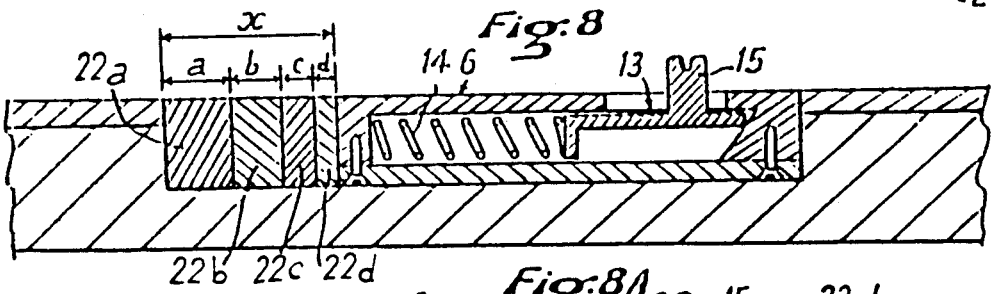
FIGS. 8 and 8A illustrate the holding in position of the recoil cartridge by means of a set of wedges of different thicknesses.
Figure 8A:
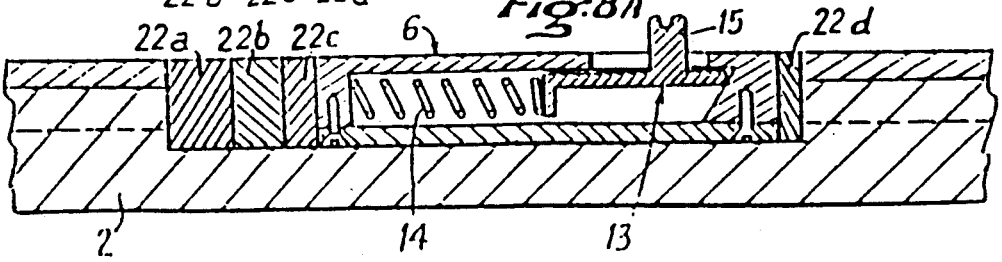

The single removable wedge 22 could also be replaced by a set of wedges of different thicknesses, as shown in FIGS. 8 and 8A. In this case, the recoil cartridge 6, having a length x shorter than its housing 7, 8, is held in the housing by means of four wedges 22*a*, 22*b*, 22*c*, 22*d* of different respective thicknesses a, b, c, d. However, the sum of these thicknesses is equal to the difference of length x between the recoil cartridge 6 and its housing 7, 8. Thus, these wedges can be placed in a certain order, depending upon the longitudinal position desired for tooth 15, i.e., the heel binding 1, behind and/or in front of the recoil cartridge 6, between the frontal walls of the recoil cartridge 6 and those of housing 7, 8.

FIG. 8 illustrates the four wedges 24*a*–24*d* positioned side-by-side behind recoil cartridge 6, while FIG. 8A shows the thinner wedge 22*d* placed in front of recoil cartridge 6, and the three other wedges 22*a*, 22*b*, 22*c* behind the cartridge.

Figure 9:
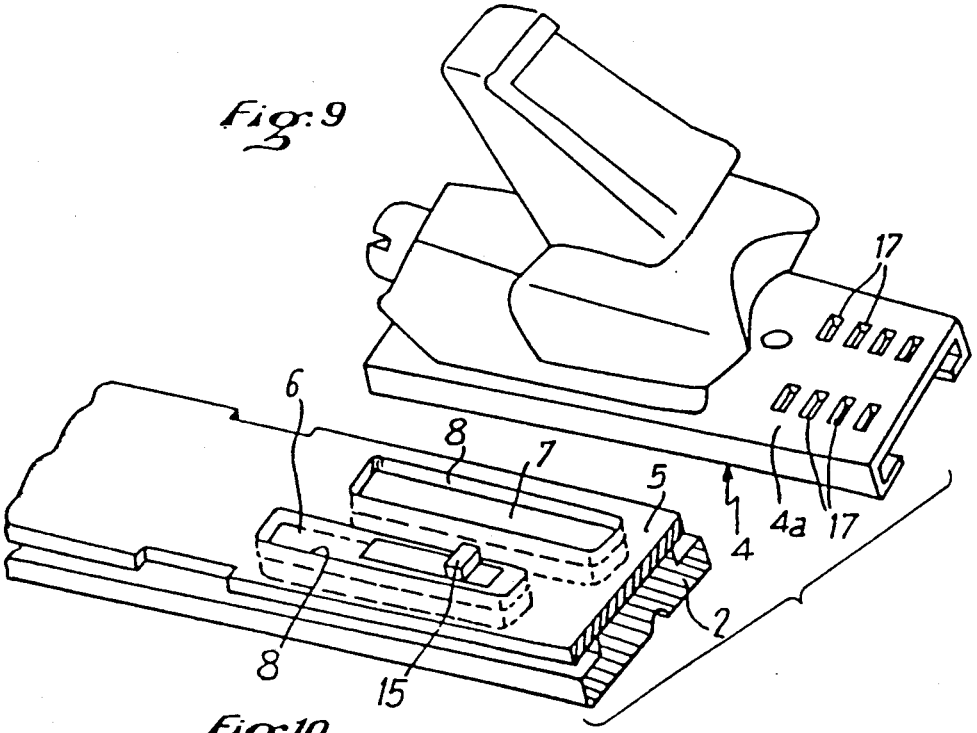
FIG. 9 is an exploded perspective view of a rear binding whose recoil cartridge can be lodged in one or another of two housings offset longitudinally.

In the alternative embodiment shown in FIG. 9, ski 2 and slide 5 have two housings 7, 8 positioned side-by-side, while being offset longitudinally with respect to one another. The recoil cartridge 6 can be placed in one or the other of these housing 7, 8 so that one can thus provide two different longitudinal positions for tooth 15 of latch 13. Base 4 has, for its part, in its member 4*a*, two successions of notches 17 which are aligned longitudinally with the two housing 7, 8, respectively.

Figure 10:
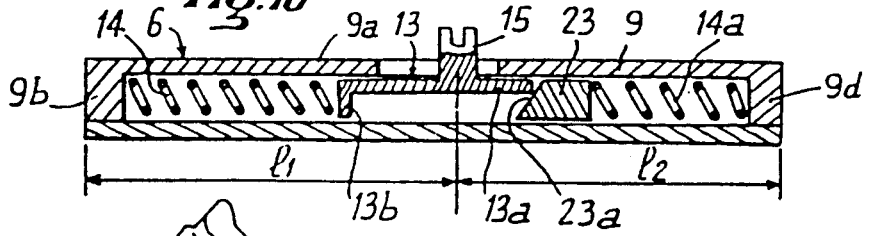
FIG. 10 is a vertical and longitudinal sectional view of an alternative embodiment of the recoil cartridge.

In the embodiment of FIG. 10, a recoil cartridge 6 which is reversible is shown, i.e., which can be placed in one direction or another. In this case, housing 9 of the recoil cartridge 6 contains two opposed compression springs 14 and 14*a*, latch 13 being placed between them. Spring 14 is lodged between the left transverse wall 9*b* of housing 9 and the squared edge 13*b* constituting the left transverse wall of latch 13. The other compression spring 14*a* is lodged between the right transverse wall 9*d* of housing 9 and a free piston 23 mounted to be longitudinally slidable within housing 9. Piston 23 has a left frontal surface 23*a* which is inclined so as to constitute a ramp on which the right end of horizontal plate 13*a* of latch 13 rests, so as to continuously push latch 13 upwardly so that its tooth 15 projects outside housing 9. In the state of equilibrium, tooth 15 is held elastically in a position in which it is at different distances $l_1$ and $l_2$ from the two longitudinal ends of recoil cartridge 6. It is thus possible, by placing recoil cartridge 6 in one direction or the other, to obtain two different longitudinal positions for the tooth 15 of latch 13 which is still elastically forwardly biased, by one of springs 14, 14*a*, whatever the position of cartridge 6.

Figure 11:
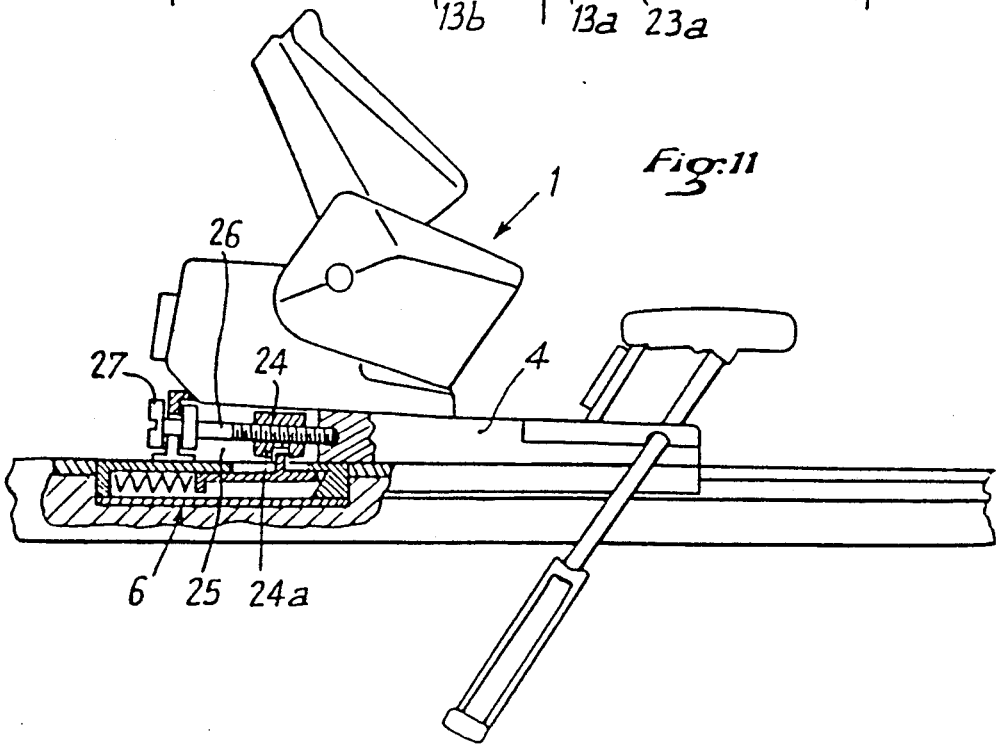
FIG. 11 is an elevation view, partially in vertical and longitudinal section, of an alternative embodiment of the rear binding.

In the alternative embodiment shown in FIG. 11, tooth 15 of latch 13 is engaged in a notch 24*a* formed in the lower surface of a slider 24 which is longitudinally adjustably mounted in a housing 25, downwardly open, which is provided in base 4 of heel binding 1. The longitudinal position of slider 24 can be adjusted by means of a screw 26 extending longitudinally and whose head 27 is mounted rotationally, while being retained in axial translation, on a transverse wall provided in the rear part of base 4, the threaded rod of screw 26 being screwed in a tapped longitudinal hole of slider 24.

Consequently, by turning screw 26 more or less in one direction or the other, whereas slider 24 is immobilized by tooth 15 of latch 13 engaged in its lower notch 24*a*, it is possible to vary in a finer manner the longitudinal position of heel binding 1.

Figure 12:
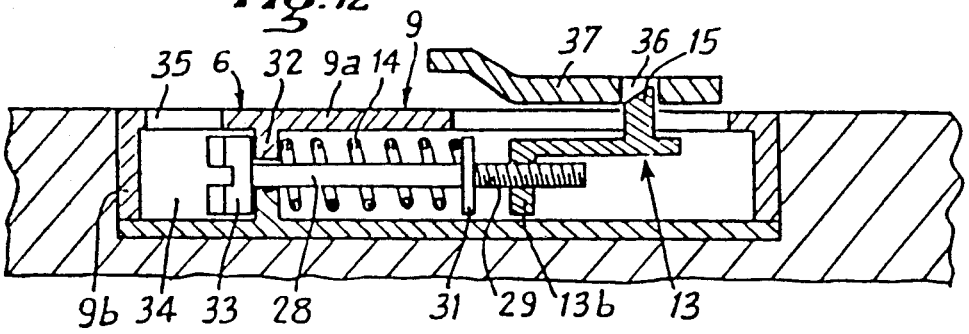
FIGS. 12 and 13 are vertical and longitudinal sectional views of other alternative embodiments of the elastic return device of the rear binding.

In the alternative embodiment shown in FIG. 12, recoil cartridge 6 contains a screw 28 for adjustment of the longitudinal position of the heel binding. This screw 28 extends longitudinally within recoil cartridge 6, and it comprises a front threaded part 29 by which it is screwed in the squared edge 13*b* constituting the rear transverse wall of latch 13. Behind its front threaded part, screw 28 supports a collar 31 serving as a support for the front end of recoil spring 14 whose rear end rests against an intermediate vertical and transverse wall 32 of housing 9 of the cartridge. This intermediate wall is traversed by the rod of screw 28 and the head 33 of the screw is situated in the space 34 defined between the intermediate vertical wall 32 and the rear transverse wall 9*b* of housing 9. The upper end 9*a* of housing 9 is provided with an opening 35 above space 34 so as to permit the introduction in this space of a tool making it possible to turn screw 28, the head 33 of the screw being preferably formed for that purpose. Consequently, the rotation of screw 28, by action on its head 33, makes it possible to vary the longitudinal position of latch 13 and tooth 15 which is solidly affixed thereto. This tooth 15 is engaged in a hole 36 provided in a retractable tongue 37 joined to the body. During a recoil movement of the heel binding 1, i.e., towards the left in FIG. 12, the body of heel binding 1 moves, by means of tongue 37, latch 13, by further compressing recoil spring 14. This movement is made possible because head 33 of screw 28 can move freely towards the rear in the rear space 34. The separation between the body of binding 1 and latch 13 is done quite easily by lifting the retractable tongue 37, so as to disengage tooth 15 from latch 13 of its reception hole 36 in tongue 37.

Figure 13:
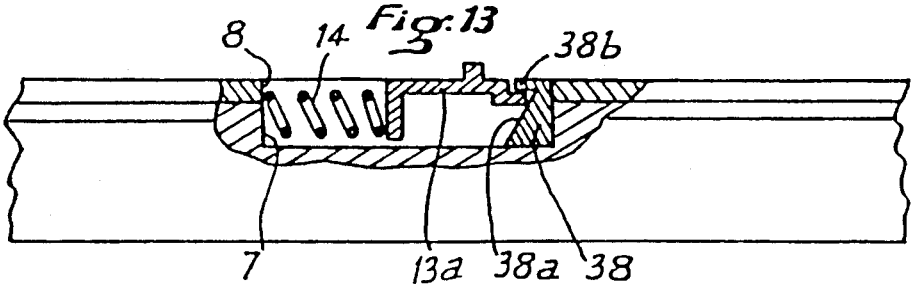

FIG. 13 illustrates an alternative embodiment in which the recoil spring 14 and latch 13 of the elastic return device are lodged directly in housing 7, 8 of ski 2 and slide 5, without having to resort to an external housing 9 as was described previously. In this case, recoil spring 14 rests, at its rear end, directly on the rear transverse wall of housing 7, 8. Moreover, the front end of the horizontal plate 13*a* of latch 13 which supports the blocking tooth 15 projecting upwardly, is pressed against the internal surface 38*a*, forming a ramp inclined from bottom to top and from rear to front, of a wedge 38 placed in the extreme front art of housing 7, 8, against the front transverse wall of the housing. The internal ramp 38*a* of wedge 38 is connected, at its upper end, to a projection 38*b* of wedge 38 which extends towards the rear and which forms an abutment for retention in the upper position for the front end of horizontal plate 13*a* of latch 13.

Figure 14:
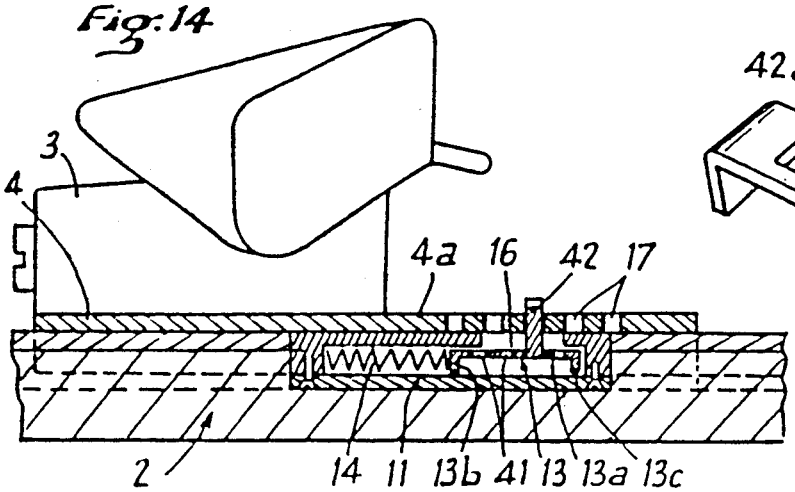
FIG. 14 is a vertical and longitudinal sectional view of a binding in which the element for transmission of the force of the elastic return device supports a removable plug.
Figure 15:
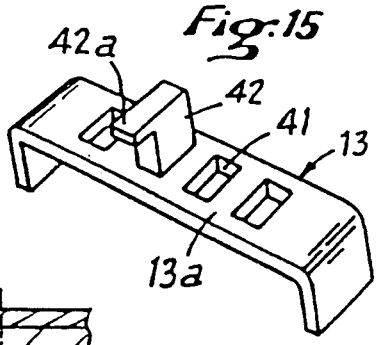
FIG. 15 is a perspective view of the linkage element having a removable plug of the binding of FIG. 14.

In the alternative embodiment shown in FIGS. 14 and 15, the linkage means of the elastic return device 6, constituted by a recoil cartridge, includes a force transmission element 13 which has, in its upper horizontal plate 13*a*, several holes 41 spaced longitudinally from one another and in which a coupling element, constituted by a removable plug 42, can be engaged. This plug 42 extends vertically through the longitudinal slit 16 provided in the upper end 9*a* of housing 9 and through one of the notches 17 of member 4*a* of base 4. It is thus possible, to selectively determine the notch 17 of base 4 and hole 41 of force transmission element 13 in which plug 42 is engaged, to adjust the longitudinal position of base 4 and of body 3 of the heel binding in the rest position. Plug 42 is driven, from top to bottom, through notch 17, slit 16 and hole 41 and to limit this driving movement, plug 42 has on its upper end a lateral projection 42*a* which rests, after being driven, on the upper surface of member 4*a* of base 4. This projection 42*a* likewise makes it possible to eject plug 42, when one wishes to modify the adjustment of the longitudinal position of heel binding 1, by means of a tool, such as a screwdriver, engaged between this projection and the upper surface of member 4*a* of base 4. It is to be noted that in this embodiment, the upper horizontal plate 13*a* of the force transmission element 13 likewise ends, at its front end, in a squared edge 13*c* extending downwardly and which constitutes a front transverse wall resting on lower cover 11. As a result, during the longitudinal movement of body 3 of the binding, the force transmission element 13 is guided and slides horizontally within recoil cartridge 6.

Figure 16:
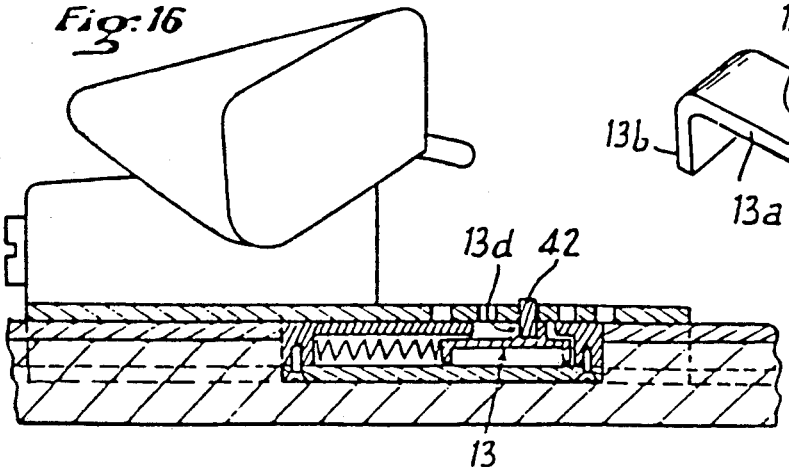
FIG. 16 is a vertical and longitudinal sectional view of another alternative embodiment of a binding whose element for transmission of force of the elastic return device supports a removable plug.
Figure 17:
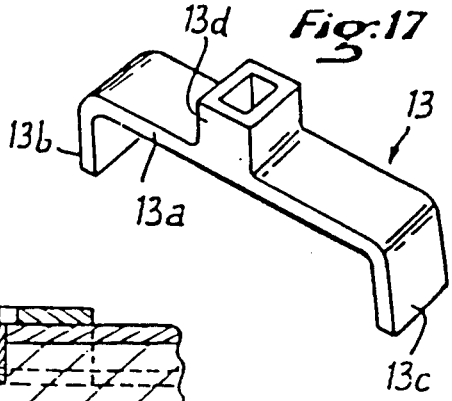
FIG. 17 is a perspective view of the force transmission element having a removable plug of the binding of FIG. 16.

In the alternative embodiment shown in FIGS. 16 and 17, the force transmission element 13 has, on the upper surface of its upper horizontal plate 13*a*, a sleeve or shaft 13*d*, extending upwardly and whose height corresponds substantially to the height of slit 16, so that the upper end of shaft 13*d* is practically flush with the upper surface of end 9*a* of housing 9. The shaft 13*d* thus constitutes a blind hole in which the removable plug 42 is completely engaged.

Figure 18:
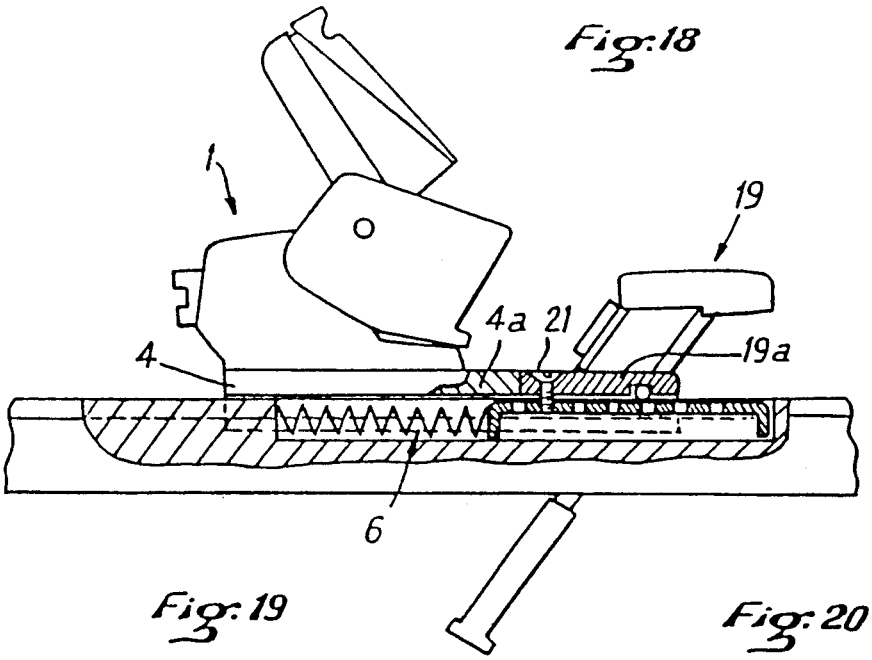
FIG. 18 is a vertical and longitudinal sectional view of another alternative of a rear binding to which a ski brake is affixed.
Figure 19:
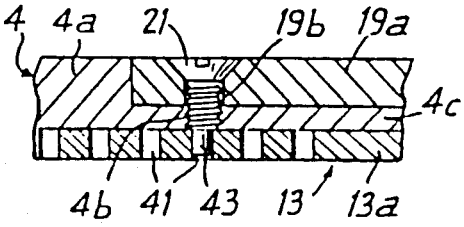
FIGS. 19 and 20 are partial vertical and longitudinal sectional views, on an enlarged scale, of the bases of the binding and brake respectively coupled with the linkage element and uncoupled therefrom.
Figure 20:
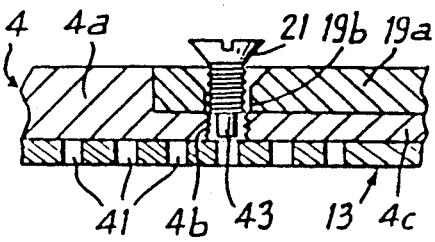

In the alternative embodiment shown in FIGS. 18–20, heel binding 1 is joined to a ski brake 19 to which it is affixed by means of a screw 21. This screw 21 constitutes, in this case, the coupling element of linkage means between base 4 and ski 2. To that end, the transmission element 13 of linkage means of the elastic return device 6 is provided, in its upper horizontal plate 13*a*, with spaced holes 41, as in the case of the embodiment shown in FIGS. 14 and 15. Moreover, screw 21 goes through a smooth hole 19*b* provided in base 19*a* of brake 19, and it is screwed in a tapped hole 4*b* provided in a part 4*c*, of lesser thickness, of the member of base 4 and on which base 19*a* of ski brake 19 is positioned. The screw 21 supports, at its lower end, a projection 43 which is engaged in one of holes 41 of transmission element 13 when the brake 19 is affixed to heel binding 1 and this brake-heel binding assembly is in turn coupled to the force transmission element 13, by means of extreme projection 43, as is shown in FIG. 19. FIG. 20 shows that the unscrewing of screw 21 has the effect of uncoupling heel binding 1 and ski brake 19 from force transmission element 13, because of the disengagement of projection 43 from the screw above element 13, and this unscrewing can simultaneously lead to the unblocking of ski brake 19 with respect to heel binding 1.

Figure 21:
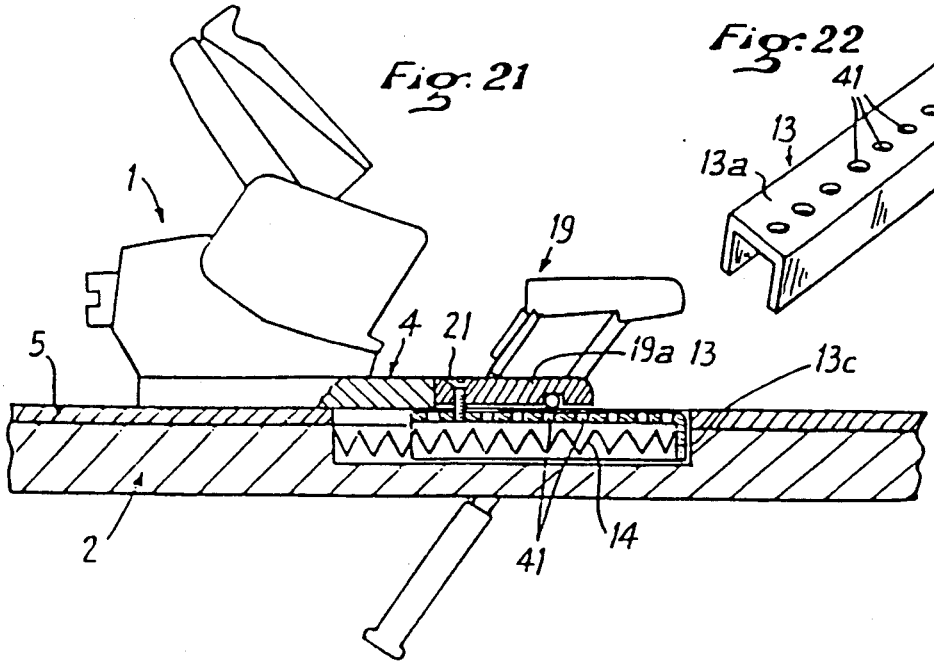
FIG. 21 is an elevation view, partially in vertical and longitudinal section, of another alternative embodiment of a rear binding to which a ski brake is joined.
Figure 22:
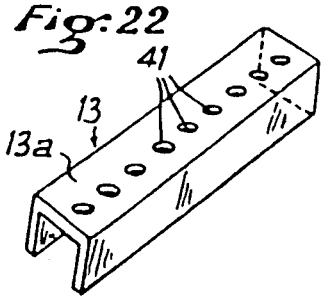
FIG. 22 is a perspective view of the force transmission element of the elastic return device of FIG. 20.

FIGS. 21 and 22 illustrate an alternative embodiment, similar to that shown in FIGS. 18-20, in which recoil spring 14 extends under the upper horizontal plate 13*a* of force transmission element 13. To that end, this element 13 is in the form of a section member with a transverse section in the shape of an inverted U, thus open downwardly, which is open at its rear end and which is closed at its front end by a front transverse wall 13*c* against which the front end of recoil spring 14 rests. This spring 14 likewise rests, at its rear end, on the rear transverse surface of its housing 7, 8 hollowed in ski 2 and slide 5. The member or the upper horizontal plate 13*a* of member 13 is, as in the case of the embodiment shown in FIGS. 18-20, provided with a succession of holes 41 in which projection 43 provided at the end of screw 21 can engage, ensuring the affixation of ski brake 19 on heel binding 1.

Although the invention has been described with reference to particular means, materials, and embodiments, it is to be understood that the invention is not limited to the particulars disclosed and extends to all equivalents within the scope of the claims.

We claim:

1. A rear binding for an alpine ski, adapted to hold the rear end of a boot on the ski, comprising:

a binding body;

a jaw carried by said body for retention of the rear end of the boot;

an energization mechanism for said jaw, also carried by said body;

a base upon which said body is solidly affixed;

a slide upon which said base is longitudinally slidably mounted;

a housing comprising an opening formed in the upper surface of the ski; and means for elastically biasing said body forwardly, comprising (i) at least one recoil spring and (ii) means for linking said body and said ski for permitting an adjustment of the longitudinal position of said body, said elastically biasing means being mounted in said housing formed in the upper surface of the ski, said recoil spring being positioned for elastically biasing the linking means with respect to the ski.

2. The binding according to claim 1, wherein said housing is constituted by a longitudinally elongated opening which is hollowed in the upper surface of a longitudinal projection of the ski, and by a longitudinally elongated slot which is provided in said slide which is affixed to the projection of the ski and which extends above said opening provided in the ski.

3. The binding according to claim 1, wherein said linking means includes a force transmission element, longitudinally movable in said housing of the ski, biased forwardly by said recoil spring, and a coupling element positioned between said base of the binding and said force transmission element.

4. The binding according to claim 3, said base comprising at least one notch, wherein said coupling element between said base of the binding and said force transmission element is constituted by a tooth solidly affixed to said force transmission element, extending upwardly and engaging in a notch provided in said base.

5. The binding according to claim 3, wherein said coupling element is removable.

6. The binding according to claim 5, wherein said removable coupling element is constituted by a screw screwed in a tapped hole provided in said base, extending through said tapped hole, said screw having an end which constitutes a projection engaging in one of several holes provided in said force transmission element and being longitudinally spaced from one another.

7. The binding according to claim 6, in combination with a ski brake including a base, wherein said screw, which ensures the coupling between said base of the binding and said force transmission element, ensures the blocking of said base of said ski brake on said base of the binding, while being engaged within a hole provided in said base of said ski brake located above said tapped hole provided in said base of the binding.

8. The binding according to claim 5, wherein said removable coupling element is constituted by a plug extending vertically through a hole provided in said base of the binding and engaged in a hole of said force transmission element.

9. The binding according to claim 8, wherein said force transmission element includes an upper horizontal plate in which several holes are provided which are longitudinally spaced from one another, and in which said removable plug is engageable.

10. The binding according to claim 8, wherein said force transmission element comprises an upwardly extending projection in the form of a sleeve constituting a blind hole in which said removable plug is engageable.

11. The binding according to claim 8, wherein said removable plug has, at an upper end, a lateral projection.

12. The binding according to claim 3, wherein said force transmission element comprises an upper horizontal plate supporting said coupling element between said base of the binding and said force transmission element and at least one frontal wall extending downwardly and constituting a support surface for the front end of said recoil spring.

13. The binding according to claim 12, wherein said upper horizontal plate of said force transmission element comprises, at its rear end, a squared edge extending downwardly and constituting a rear frontal wall on which the front end of said recoil spring rests.

14. The binding according to claim 13, wherein said upper horizontal plate of said force transmission element comprises, at its front end, a squared edge extending downwardly and constituting a front transverse wall.

15. The binding according to claim 12, wherein said force transmission element comprises a section member having a transverse section in the shape of an inverted U, open at its rear end and closed at its front end by a front transverse wall against which the front end of said recoil spring rests.

16. The binding according to claim 1, wherein said elastically biasing means is mounted directly in said housing.

17. The binding according to claim 16, wherein said recoil spring rests, at a rear end thereof, directly on a rear transverse wall of said housing and, at a front end thereof, on a transverse wall of said force transmission element which comprises an upper horizontal plate.

18. The binding according to claim 17, wherein said upper horizontal plate of said force transmission element comprises a front end which is pressed against an internal surface, forming a ramp inclined from bottom to top and from rear to front of a wedge positioned in the extreme front part of said housing against the front transverse wall of said housing, said ramp of said wedge joining, at its upper end, a projection of said wedge which extends rearwardly and which forms a retention abutment in the upper position for the front end of the upper horizontal plate of force transmission element.

19. The binding according to claim 2, wherein said elastically biasing means of said body comprises an independent recoil cartridge which is tightly nested in said housing provided in the ski and the slide.

20. The binding according to claim 19, wherein said recoil cartridge has a generally parallelepiped shape.

21. The binding according to claim 20, wherein said recoil cartridge has dimensions which correspond closely to those of said housing provided in the ski and the slide.

22. The binding according to claim 20, wherein said recoil cartridge has a length less than that of said housing and at least one removable wedge is provided to fill the space remaining between said recoil cartridge and one of the frontal walls of said housing.

23. The binding according to claim 22, wherein said recoil cartridge is held in said housing by a plurality of removable wedges of different thicknesses inserted between the frontal walls of said recoil cartridge and the frontal walls of said housing.

24. The binding according to claim 19, wherein the ski and the slide have a plurality of housings positioned side-by-side and longitudinally offset longitudinally with respect to one another, said recoil cartridge being capable of being placed in any one of said housings.

25. The binding according to claim 19, wherein said recoil cartridge contains two opposed compression springs, said force transmission element being positioned between them, one of said two springs being positioned between a first transverse wall of said housing of said cartridge and a first end of an upper horizontal plate of said force transmission element, the other of said two springs being positioned between a second transverse wall of said housing and a free piston longitudinally slidably mounted within said housing, said piston having a frontal surface which is inclined so as to constitute a ramp on which the second end of the upper horizontal plate of said force transmission element rests, so as to continuously bias said force transmission element upwardly so that said coupling element that it supports projects to the exterior of said housing while being, in a state of equilibrium, held elastically in a position in which it is at different respective distances from the two longitudinal ends of said recoil cartridge.

26. The binding according to claim 19, wherein said linking means includes a force transmission element, longitudinally movable in said housing of the ski, biased forwardly by said recoil spring, and a coupling element positioned between said base of the binding and said force transmission element, wherein said recoil cartridge comprises two parts, an upper housing and a lower cover, which is affixed to said housing by means of screws, said force transmission element being positioned in a space defined between said upper housing and said lower cover, said force transmission element comprising an upper horizontal plate which supports, on its upper surface, said coupling element projecting upwardly, said coupling element extending through a longitudinally elongated slit which is provided in the upper end of said housing, said upper plate of said force transmission element being extended, at a rear end, by a squared edge extending downwardly and which constitutes a rear transverse wall on which the front end of said recoil spring rests, whose rear end rests on a rear transverse wall of housing, and a front end of said upper horizontal plate of said force transmission element rests against a ramp which is inclined from bottom to top and from rear to front, said inclined ramp constituting the internal surface of the front wall of said housing.

27. The binding according to claim 1, wherein said base of the binding has an upper horizontal member which includes a succession of notches generally aligned longitudinally, forming a rack, in which a coupling element of a force transmission element can be engaged, said notches defining the various longitudinal positions that said body of the binding can take on said slide.

28. The binding according to claim 27, wherein said coupling element comprises a tooth which has a recess in its upper surface, said recess being adapted to receive the end of a tool to push said tooth downwardly, outside of said notch.

29. The binding according to claim 19, wherein said recoil cartridge contains a screw for adjustment of the longitudinal position of the heel binding, said screw extending longitudinally within said recoil cartridge and comprising a front threaded part by which it is screwed in said force transmission element, said screw supporting, behind a front part thereof, a collar serving to support the front end of said recoil spring whose rear end rests against an intermediate transverse and vertical wall of said housing of said recoil cartridge, said screw extending through said intermediate wall and said head of said screw being located in a space defined between said intermediate wall and said rear transverse wall of said housing, and the upper end of said housing being provided with an opening above said space so as to permit the introduction into said space of a tool for turning said screw.

30. The binding according to claim 29, wherein said coupling element of said force transmission element is engaged in a hole provided in a retractable tongue joined to said body of the binding.

31. The binding according to claim 27, wherein a rear part of said coupling tooth of said force transmission element comprises a bevel, inclined from bottom to top and from rear to front, so that under the effect of a forward thrust exerted on said body and said base, said tooth and said force transmission element are pushed downwardly due to the action exerted by the rear edge of each notch on said bevel.

32. The binding according to claim 1, wherein said coupling element of said force transmission element is engaged in a notch formed in the lower surface of a slider which is longitudinally adjustably mounted in a downwardly open housing which is provided in said base of the binding.

33. The binding according to claim 32, wherein said longitudinal position of said slider is adjustable by means of a screw extending longitudinally and whose head is rotationally mounted, while being held in axial translation, on a transverse wall provided in the rear part of said base, the threaded rod of screw being screwed in a longitudinal tapped hole of said slider.

34. The binding according to claim 3 in combination with a brake and means for securing said brake to said base.

35. The binding according to claim 34, said means for securing said brake to said base being constituted by said coupling element.

36. The binding according to claim 34, said means for securing said brake to said base being constituted by a fastening element independent of said coupling element.

37. A ski binding apparatus comprising:

(a) means for engaging an end of a ski boot for positioning said ski boot upon a ski;

(b) a base upon which said engaging means is mounted; and (c) means for connecting said base to the ski at a predetermined rest position comprising (i) means for elastically biasing said base in a predetermined longitudinal direction on the ski and (ii) means for selectively longitudinally adjusting said predetermined rest position of said base upon the ski;

wherein said means for elastically biasing said base comprises at least one spring, a force transmission element, and means for containing said at least one spring and said force transmission element, wherein said containing means is adapted to be rigidly affixed to the ski and comprises a cartridge having a fixed length adapted to be received in an opening in an upper portion of the ski, wherein said means for selectively longitudinally adjusting said predetermined rest position of said base upon the ski comprises a number of removable wedge members for selective positioning within said opening in the ski, wherein said force transmission element is selectively movably connected to said base, and wherein said force transmission element is longitudinally biased within said containing means by said at least one spring.

38. The binding apparatus of claim 37, further comprising a slide upon which said base is longitudinally slidably received, wherein said containing means comprises a cartridge having a fixed length adapted to be received in an opening in said slide, and wherein said means for selectively longitudinally adjusting said predetermined rest position of said base upon the ski comprises a number of removable wedge members for selective positioning within said opening in said slide.

39. The binding apparatus of claim 37, wherein said binding apparatus is adapted to engage the rear of a ski boot.

40. A ski binding apparatus comprising:

(a) means for engaging an end of a ski boot for positioning said ski boot upon a ski;

(b) a base upon which said engaging means is mounted;

(c) means for connecting said base to the ski at a predetermined rest position comprising (i) means for elastically biasing said base in a predetermined longitudinal direction on the ski and (ii) means for selectively longitudinally adjusting said predetermined rest position of said base upon the ski; and (d) a slide upon which said base is longitudinally slidably received;

wherein said means for elastically biasing said base comprises at least one spring, a force transmission element, and means for containing said at least one spring and said force transmission element, wherein said containing means is adapted to be rigidly affixed to the ski and comprises a cartridge having a fixed length adapted to be received in said slide, wherein said cartridge is adapted to be received in an opening in an upper portion of the ski which opening coincides with said opening in said slide, wherein said means for selectively longitudinally adjusting said predetermined rest position of said base upon the ski comprises a number of removable wedge members for selective positioning within said opening in the ski, wherein said force transmission element is selectively movably connected to said base, and wherein said force transmission element is longitudinally biased within said containing means by said at least one spring.

41. The binding apparatus according to claim 37, further comprising a brake and means for securing said brake to said base, said means for elastically biasing said base comprising at least one spring, a force transmission element, and means for coupling said force transmission element to said base for operatively positioning said force transmission element between said base and said at least one spring, and wherein said means for securing said brake to said base further comprises means separate from said means for coupling said force transmission element and said base.

42. A skin binding apparatus comprising:

(a) means for engaging an end of a ski boot for positioning said skin boot upon a ski;

(b) a base upon which said engaging means is mounted; and (c) means for connecting said base to the ski at a predetermined rest position comprising (i) means for elastically biasing said base in a predetermined longitudinal direction on the ski, (ii) means for containing said elastically biasing means, said containing means being adapted to be rigidly affixed to the ski, and (iii) means for selectively longitudinally adjusting said predetermined rest position of said base upon the ski, while retaining said containing means rigidly affixed to said ski.

43. The binding apparatus of claim 42, wherein:

said means for selectively longitudinally adjusting said predetermined rest position of said base upon said ski further comprises a force transmission element engaged by said elastically biasing means and operatively connected to said base; and said containing means comprises a cartridge within which said elastically biasing means and said force transmission element are received, said cartridge being adapted to be rigidly affixed to said ski.

* * * * *